US008103189B2

(12) United States Patent
Maeda

(10) Patent No.: US 8,103,189 B2
(45) Date of Patent: Jan. 24, 2012

(54) IMAGE FORMING APPARATUS HAVING REMOVABLE BELT

(75) Inventor: Masafumi Maeda, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 60 days.

(21) Appl. No.: 12/393,896

(22) Filed: Feb. 26, 2009

(65) Prior Publication Data

US 2009/0214274 A1 Aug. 27, 2009

(30) Foreign Application Priority Data

Feb. 26, 2008 (JP) ..... 2008-043983

(51) Int. Cl.
*G03G 15/08* (2006.01)

(52) U.S. Cl. ..... 399/121; 399/302

(58) Field of Classification Search ..... 399/121, 399/302, 308

See application file for complete search history.

(56) References Cited

U.S. PATENT DOCUMENTS

2007/0025762 A1* 2/2007 Kato et al. ..... 399/121

FOREIGN PATENT DOCUMENTS

| | | |
|---|---|---|
| JP | 07-020725 | 1/1995 |
| JP | 2001-139176 | 5/2001 |
| JP | 2002-229385 | 8/2002 |
| JP | 2002-365932 | 12/2002 |
| JP | 2003-098936 | 4/2003 |

* cited by examiner

*Primary Examiner* — Hoang Ngo

(74) *Attorney, Agent, or Firm* — Canon U.S.A., Inc., IP Division

(57) ABSTRACT

A belt unit having a belt stretched by a plurality of rollers is removably mounted in an image forming apparatus. A pressure removing member moves a tension roller for applying tension to the belt from a first position to apply the tension to the belt to a second position to remove the tension from the belt. After the belt unit is positioned and mounted in the apparatus body by engaging the rollers with positioning portions in an apparatus body frame in a state in which the tension roller is moved to the second position by the pressure removing member, the tension is applied to the belt by moving the tension roller to the first position by the pressure removing member.

15 Claims, 11 Drawing Sheets

IMAGE FORMING APPARATUS HAVING REMOVABLE BELT

BACKGROUND OF THE INVENTION

1. Field of the Invention

The present invention relates to an image forming apparatus that forms an image on a recording material by electrophotography, and more particularly, to an image forming apparatus to which a belt unit having a belt stretched by a plurality of stretching members is removably mounted.

2. Description of the Related Art

In known electrophotographic image forming apparatuses, a toner image on a photosensitive drum is electrostatically transferred onto a belt (or a recording material on the belt) that is stretched by a plurality of tension rollers serving as stretching members. In these image forming apparatuses, it is known that the belt and the tension rollers are combined into one belt unit and the belt unit is removably mounted in the main body of the image forming apparatus.

Japanese Patent Laid-Open No. 2001-139176 discloses a structure for positioning such a belt unit relative to the apparatus body. In this structure disclosed in the publication, positioning is performed by directly pressing two tension rollers, by which a surface of a belt facing a photosensitive drum is stretched, against positioning portions provided in a frame of the apparatus body so that the tension rollers engage with the positioning portions.

In this case, one of the two tension rollers has space with respect to the corresponding positioning portion in the frame of the apparatus body. This prevents interference of the center distance between the two tension rollers with the positioning portions in the frame of the apparatus body. Since the center distance between the tension rollers is determined by the positioning portions in the frame, an error of alignment of the tension rollers can be minimized.

Unfortunately, in the above-described publication, during replacement of the belt unit, the belt is tensioned by the tension rollers. In the belt unit, one bearing portion is fixed to the interior of the belt unit, and another bearing portion is biased by the tension of the belt in a direction to decrease the center distance between the tension rollers. For this reason, when replacing the belt unit, it is necessary to engage the tension rollers with the positioning portions of the frame while increasing the center distance between the tension rollers against the tension. This may reduce operability during replacement of the belt unit. Moreover, when the tension rollers are engaged with the positioning portions in the frame of the apparatus body in a state in which the center distance therebetween is reduced, they may be worn by rubbing against the positioning portions because of the tension.

SUMMARY OF THE INVENTION

The present invention enhances operability and minimizes wear of tension rollers during replacement of a belt unit.

An image forming apparatus according to an aspect of the present invention includes an image bearing member configured to bear a toner image; a main body having an apparatus body frame; a positioning portion provided in the apparatus body frame; a removable belt unit configured to be engaged with the positioning portion so as to be positioned in the main body, the belt unit including a belt configured to transfer the toner image from the image bearing member onto a recording material, first and second stretching members configured to stretch an inner surface of the belt, a third stretching member configured to stretch the inner surface of the belt so as to apply tension to the belt, and a belt frame configured to hold the first, second, and third stretching members; and a pressure removing member configured to move the third stretching member from a first position to apply the tension to the belt to a second position to remove the tension from the belt. After the belt unit is positioned in the main body by engaging the first and second stretching members with the positioning portion of the apparatus body frame in a state in which the third stretching member is placed at the second position by the pressure removing member, the tension is applied to the belt by moving the third stretching member from the second position to the first position by the pressure removing member.

Further features of the present invention will become apparent from the following description of exemplary embodiments with reference to the attached drawings.

DESCRIPTION OF THE EMBODIMENTS

Exemplary embodiments of the present invention will be described in detail below with reference to the drawings. The dimensions, materials, shapes, and relative positions of the structural components described in the following preferred embodiments are to be appropriately modified in accordance with the structure and various conditions of the apparatus to which the present invention is applied. Therefore, the following exemplary embodiments are not intended to limit the scope of the present invention, unless otherwise specified.

An image forming apparatus according to a first embodiment of the present invention will be described in detail with reference to FIGS. 1 to 9. In the first embodiment, a laser beam printer is given as an example of an image forming apparatus. In the image forming apparatus, color toner images on photosensitive drums serving as image bearing members are sequentially transferred onto a belt, and are then simultaneously transferred from the belt onto a recording material.

Figure 1:
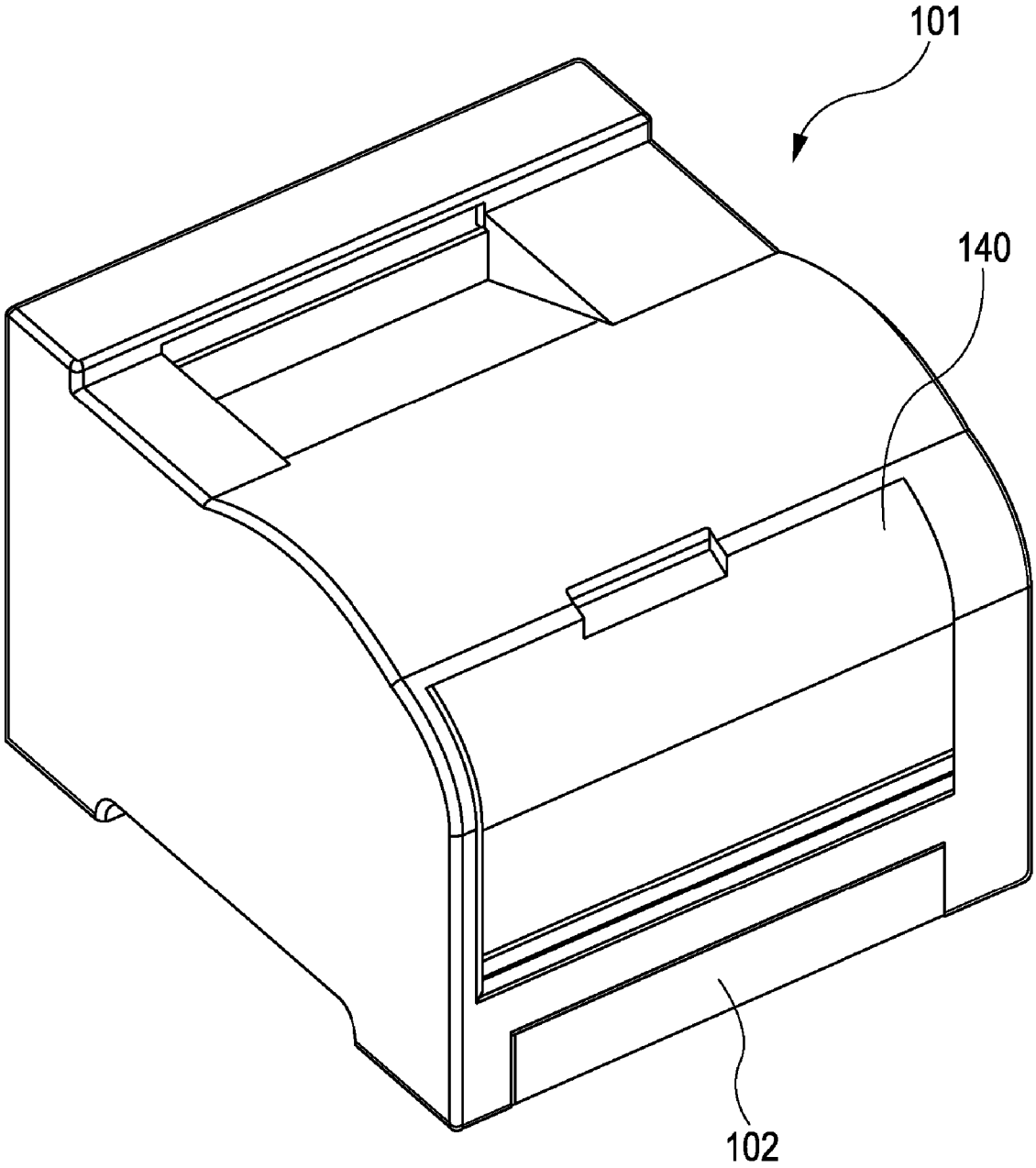
FIG. 1 is an external perspective view of an image forming apparatus.
Figure 2:
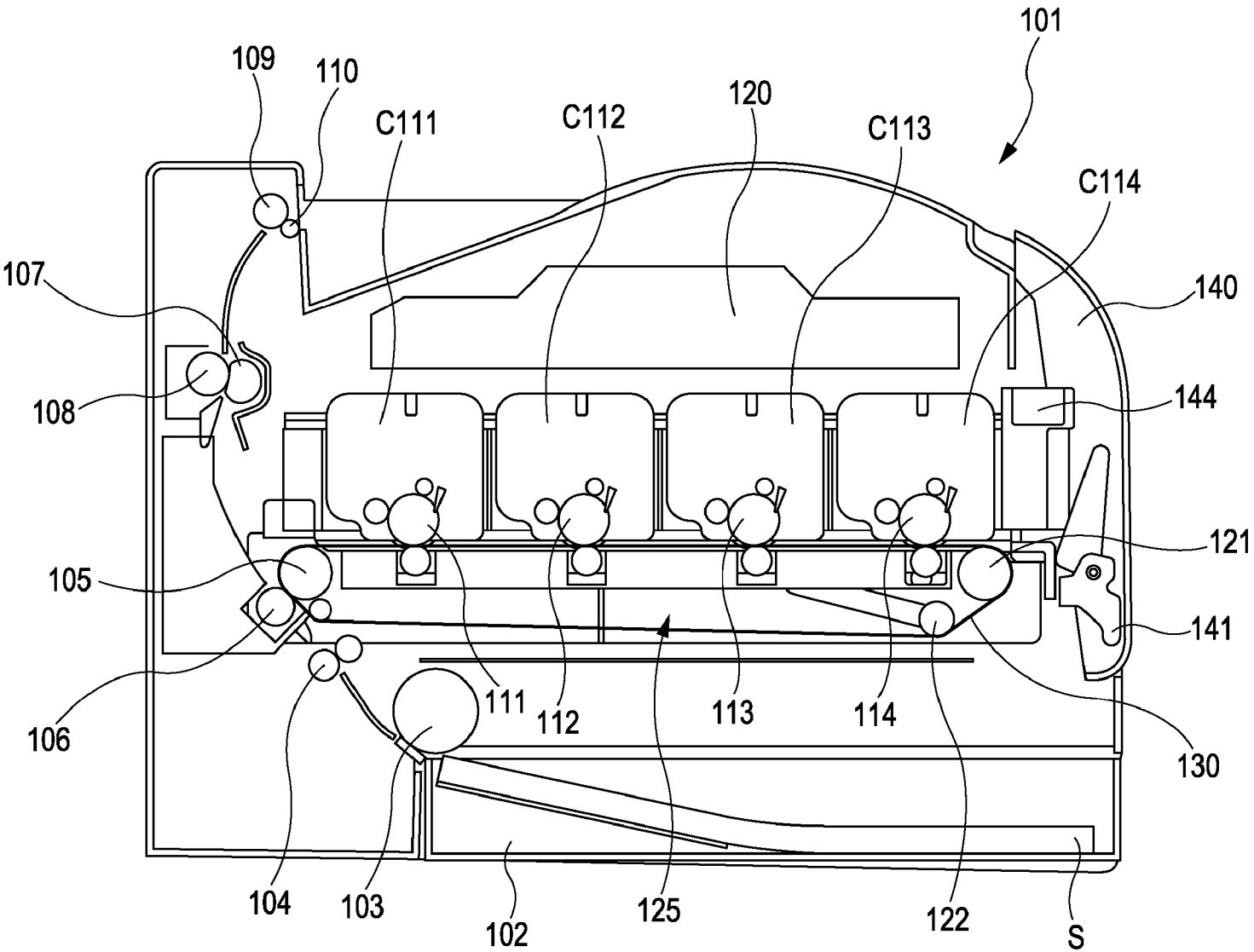
FIG. 2 is a schematic cross-sectional view of the image forming apparatus.

First, the overall configuration and functions of a laser beam printer serving as the image forming apparatus of the first embodiment will be described with reference to FIGS. 1 and 2. FIG. 1 is an external perspective view of the image forming apparatus, and FIG. 2 is a schematic cross-sectional view of the image forming apparatus.

Recording media S stacked in a feeder tray 102 are fed by a feeding roller 103 that rotates counterclockwise in the figures, are conveyed to conveying rollers 104, and are then conveyed to a nip portion (primary transfer nip portion) between a facing roller 105 and a transfer roller 106.

Photosensitive drums 111, 112, 113, and 114 serving as image bearing members that constitute image forming sections rotate counterclockwise in the figures. In the image forming sections, electrostatic latent images are sequentially formed on outer peripheral surfaces of the photosensitive drums 111, 112, 113, and 114 by laser light from a laser scanner 120, and are then developed by developing rollers so as to form toner images.

The toner images formed on the photosensitive drums 111, 112, 113, and 114 are transferred onto an intermediate transfer belt 130. In order to form a color image, toner images of yellow, magenta, cyan, and black are respectively developed on the photosensitive drums 111, 112, 113, and 114, and are then sequentially transferred onto the intermediate transfer belt 130.

The toner images formed on the intermediate transfer belt 130 are transferred together onto a recording material S that is conveyed to the nip portion (secondary transfer nip portion) between the facing roller 105 and the transfer roller 106.

The recording material S on which the toner images have been transferred is conveyed to a nip portion between a fixing film 107 and a pressure roller 108, and is fixed onto the recording material S by heat and pressure.

After the toner images are fixed, the recording material S is discharged by discharge rollers 109 and 110.

The photosensitive drums 111, 112, 113, and 114 are combined with processing devices that act on the drums into process cartridges C111, C112, C113, and C114. The process cartridges C111, C112, C113, and C114 are removably mounted in the main body of the image forming apparatus. A process cartridge refers to a cartridge formed by a combination of an image bearing member, and a charging device, a developing device, and a cleaning device serving as processing devices acting on the image bearing member. This cartridge is removably mounted in the body of the image forming apparatus.

Figure 3:
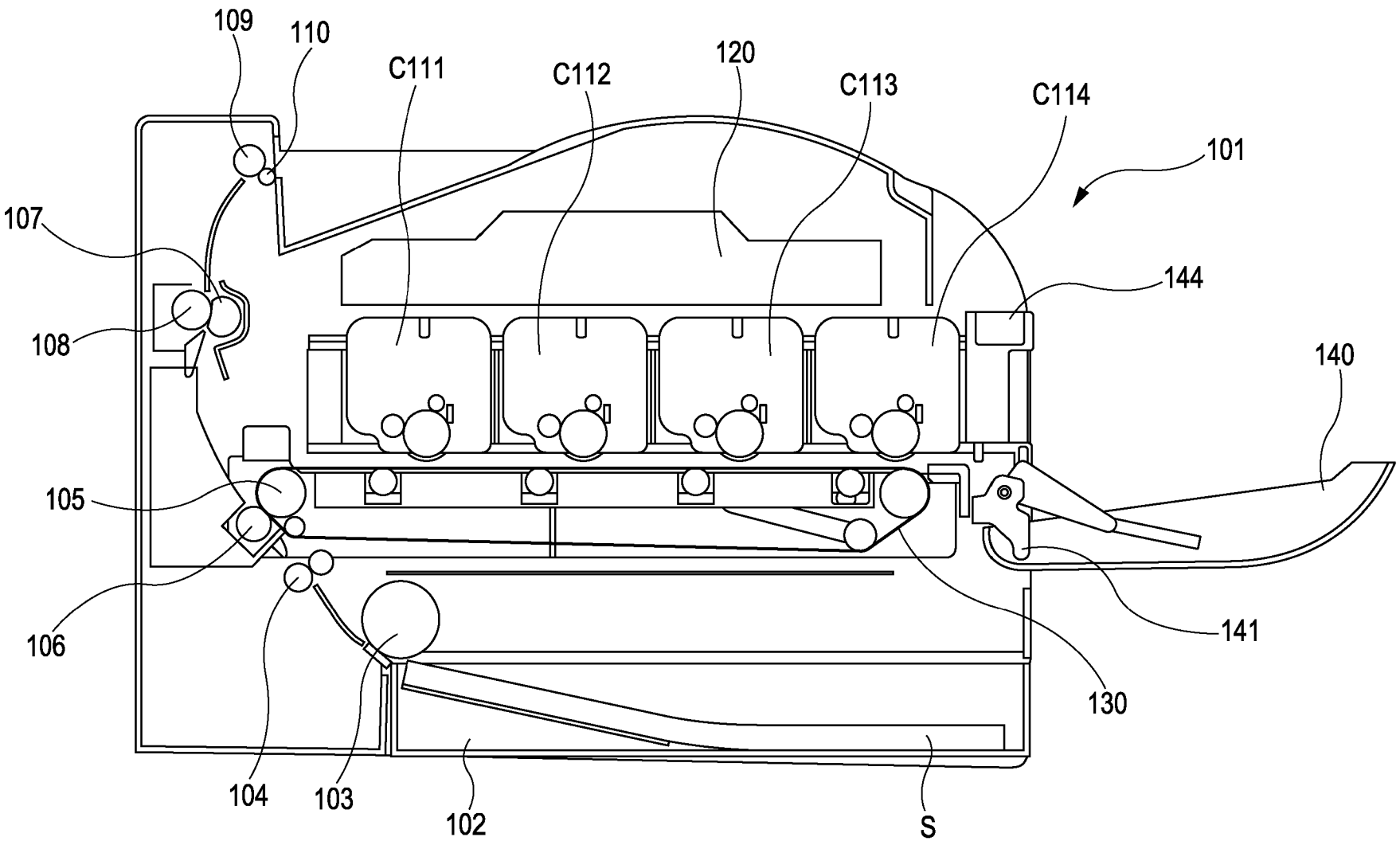
FIG. 3 is a schematic cross-sectional view of the image forming apparatus in a state in which a door is open.
Figure 4:
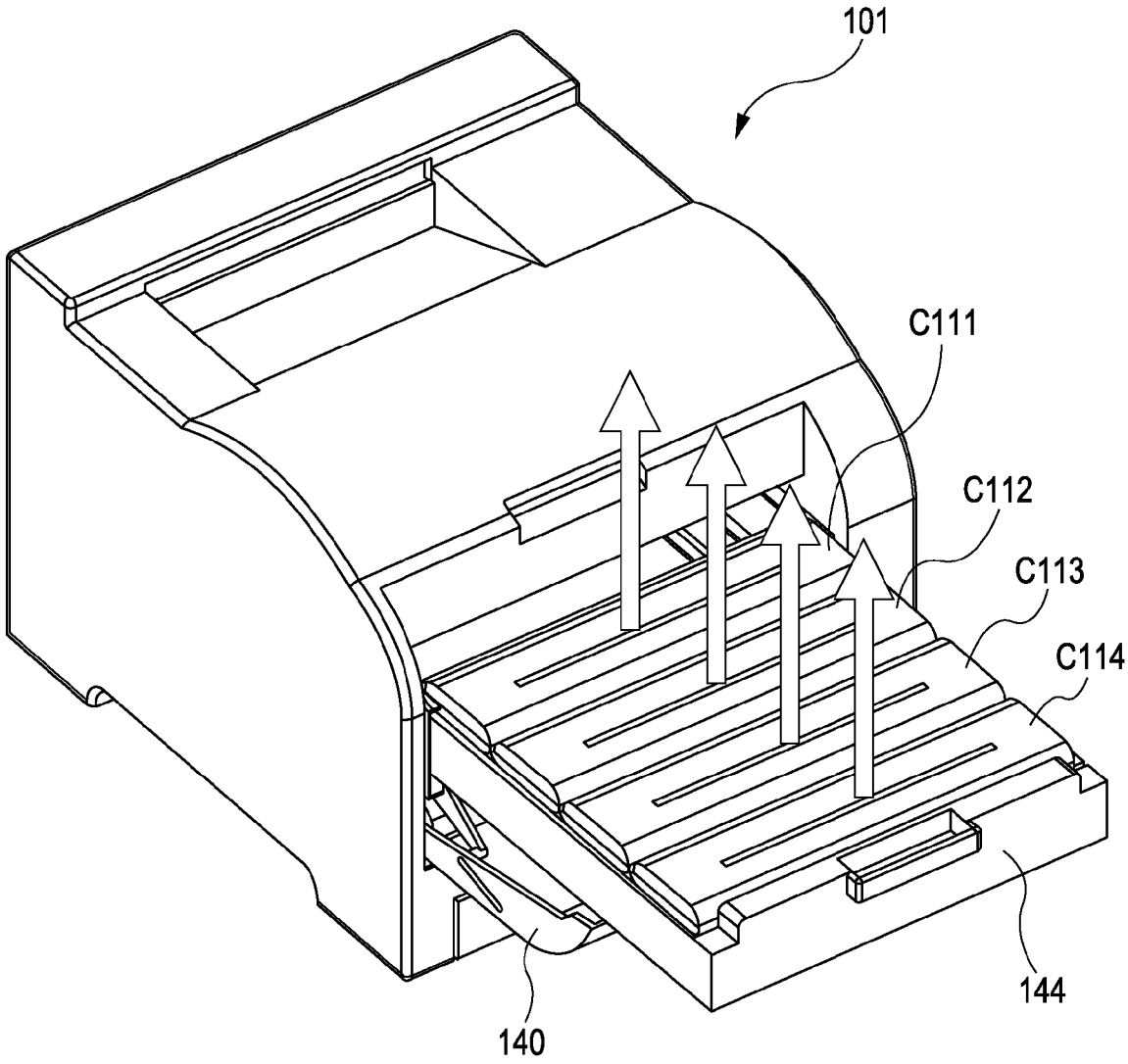
FIG. 4 is a perspective view of the image forming apparatus, illustrating replacement of a process cartridge.
Figure 5:
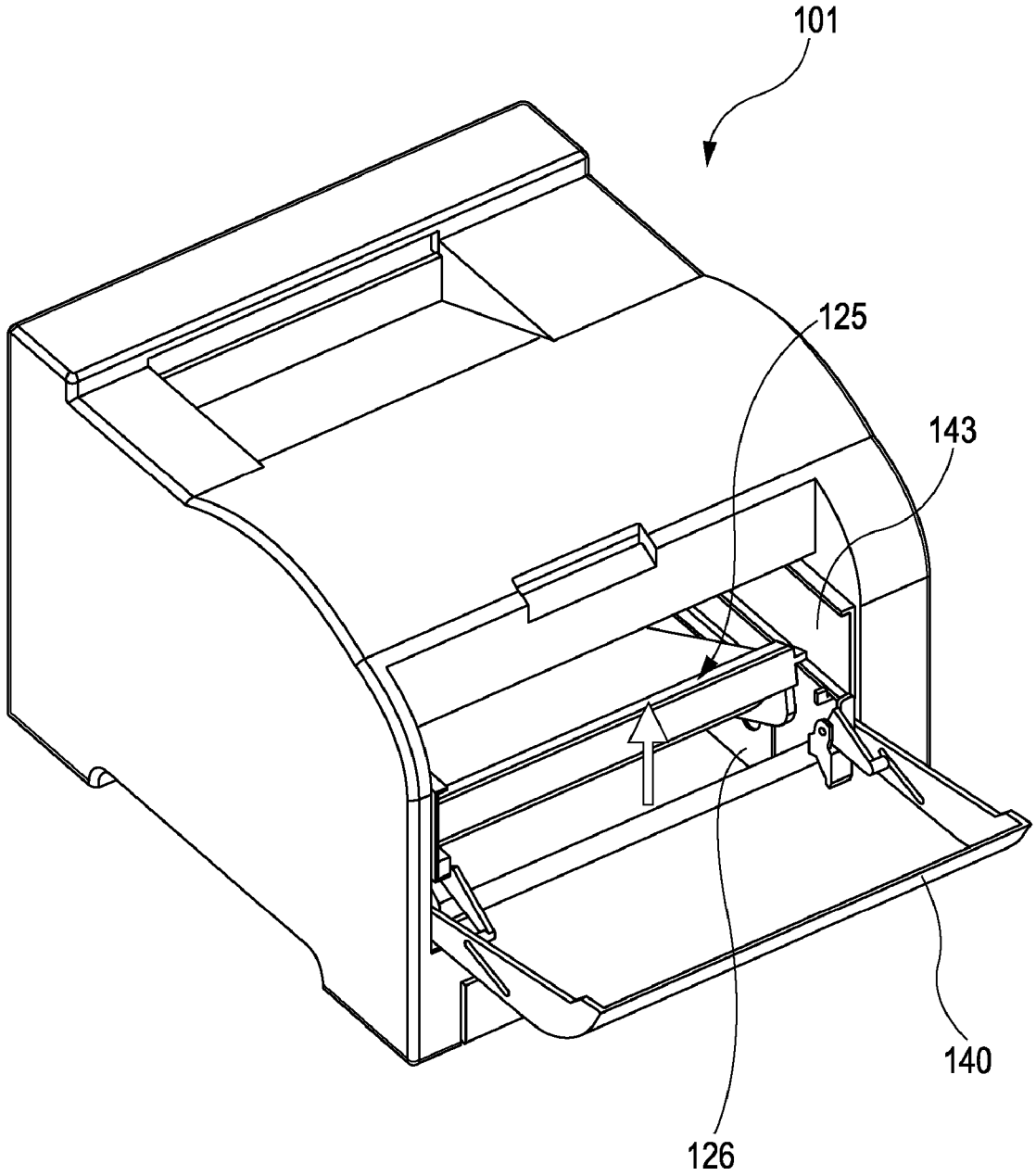
FIG. 5 is a perspective view of the image forming apparatus, illustrating replacement of a belt unit.

Next, a method of replacing the process cartridges will be described briefly with reference to FIGS. 3 to 5. FIG. 3 is a schematic cross-sectional view of the image forming apparatus in which a cartridge door is open. FIG. 4 is a perspective view of the image forming apparatus, illustrating replacement of the process cartridges. FIG. 5 is a schematic perspective view of the image forming apparatus, illustrating replacement of a belt unit.

In the image forming apparatus of the first embodiment, in order to enhance operability, the cartridges are replaced by a front access method while being placed on a pull-out tray. That is, a cartridge door 140 is provided at the front of the image forming apparatus. The cartridge door 140 opens and closes to form an opening through which the cartridges can be inserted into an apparatus body 101 and can be removed from the apparatus body 101. In the first embodiment, the cartridge door 140 can open and close by pivoting relative to the apparatus body 101 on a lateral shaft 141 provided at the lower side thereof.

As shown in FIG. 4, the process cartridges C111, C112, C113, and C114 are removably mounted in a cartridge tray 144 to be inserted into and drawn out from the apparatus body 101. The cartridge tray 144 is held by a pair of tray holding members 143 (see FIG. 5) provided in right and left frames of the apparatus body 101 that constitute an apparatus body frame. The cartridge tray 144 is horizontally slidable in the frontward and rearward directions. Here, the frontward direction refers to a direction in which the tray 144 is drawn out from the apparatus body 101, and the rearward direction refers to a direction in which the tray 144 is inserted into the apparatus body 101. The tray holding members 143 move upward in the frontward direction by a predetermined amount in association with the opening pivotal motion of the cartridge door 140. With the movement of the tray holding members 143, the cartridge tray 144 also moves upward, and the photosensitive drums 111 to 114 are raised from the intermediate transfer belt 130, so that the cartridge tray 144 becomes ready to be drawn out of the apparatus body 101.

When the cartridge tray 144 is drawn out of the apparatus body 101, as shown in FIG. 4, the upper sides of the process cartridges C111, C112, C113, and C114 are opened, and the process cartridges C111, C112, C113, and C114 become ready to be removed in the directions of the arrows. In order to mount the process cartridges C111, C112, C113, and C114, the removal procedure is reversed.

A method of mounting and removing a belt unit 125 will now be described with reference to FIG. 5. First, the structure of the belt unit 125 shown in FIG. 5 will be described with reference to FIG. 2. The belt unit 125 includes the intermediate transfer belt 130 used to transfer toner images from the photosensitive drums onto a recording material. The belt unit 125 also includes a facing roller 105 serving as a first stretching member and a driving roller 121 serving as a second stretching member. The facing roller 105 and the driving roller 121 stretch the intermediate transfer belt 130 by contact with an inner surface of the intermediate transfer belt 130, that is, stretch a surface of the intermediate transfer belt 130 facing the photosensitive drums 111, 112, 113, and 114. The driving roller 121 also functions as a driving source for rotating the belt unit 125. The facing roller 105 also functions as a roller for forming the secondary transfer nip portion between the facing roller 105 and the transfer roller 106 so that the intermediate transfer belt 130 lies therebetween, as described above.

The belt unit 125 also includes a tension roller 122 serving as a third stretching member that stretches the intermediate transfer belt 130 and applies tension to the intermediate transfer belt 130. The third stretching member urges the intermediate transfer belt 130 from the inner side toward the outer side by a force greater than the forces of the first and second stretching members. These rollers 105, 121, and 122 are held by a belt frame 124. The belt frame 124 includes a first belt frame portion 124*a* serving as a first frame portion and a belt frame portion 124*b* serving as a second frame portion.

One of the belt frame portions 124*a* and 124*b* is movable relative to the other belt frame portion, and the belt frame portions 124*a* and 124*b* are combined into the belt unit 125 that is removably mounted in the apparatus body 101.

The belt unit 125 is positioned in the apparatus body 101 by engaging with positioning portions 126*a* and 126*b* provided in an apparatus body frame 126 that constitute the apparatus body 101 with the right and left frames of the apparatus body 101. The belt unit 125 is replaced in a state in which the cartridge door 140 is open and the cartridge tray 144 is drawn out of the apparatus body 101, as shown in FIG. 4. After the cartridge tray 144 is removed, the belt unit 125 is disengaged from the positioning portions 126*a* and 126*b* in the apparatus body frame 126 by lifting the front side of the belt unit 125 in the direction of the arrow in FIG. 5, so that the belt unit 125 can be drawn forward from the apparatus body 101.

Figure 6:
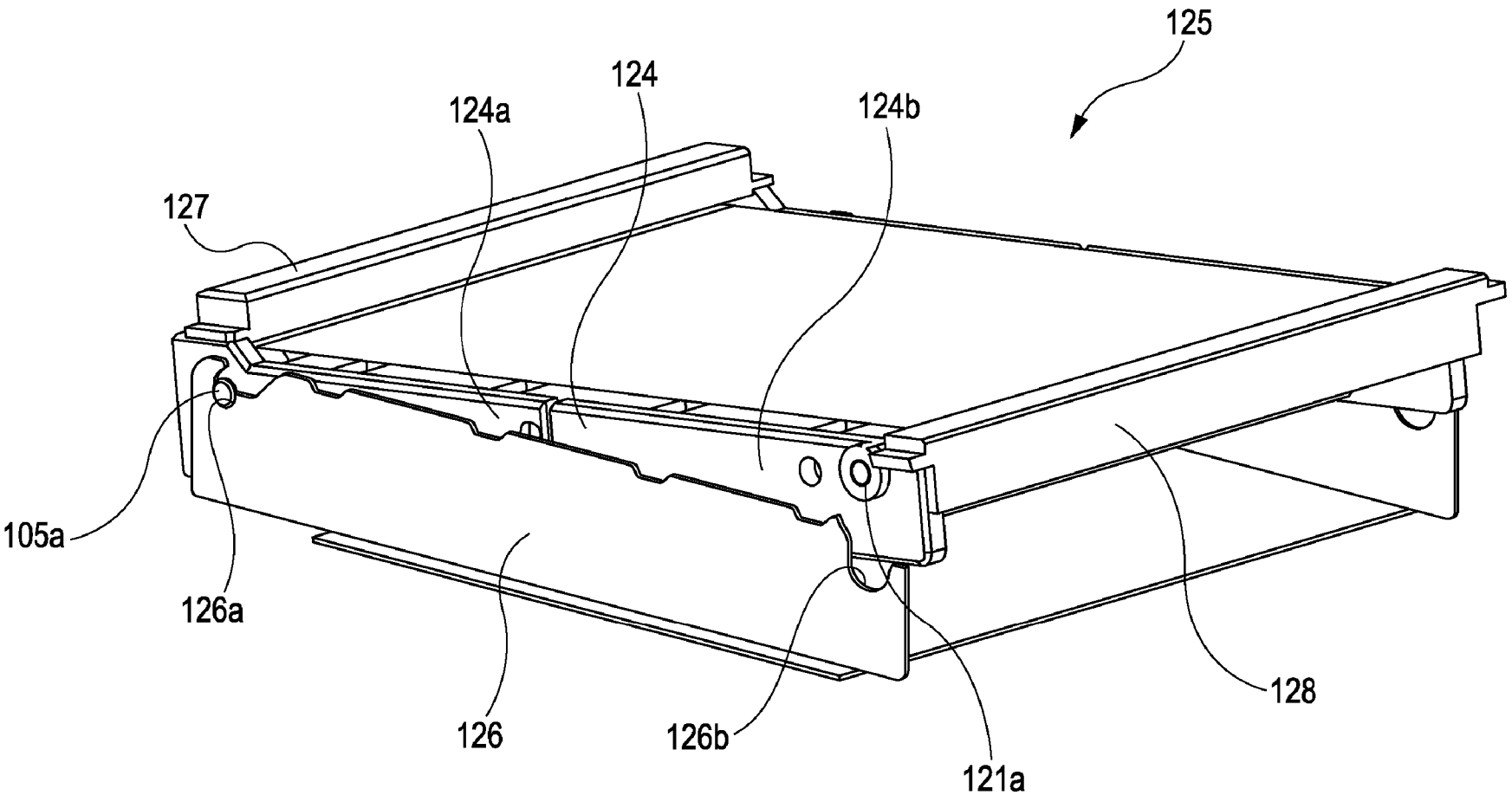
FIG. 6 is a perspective view illustrating the relationship between a belt unit and positioning portions in an apparatus body according to a first embodiment.
Figure 7:
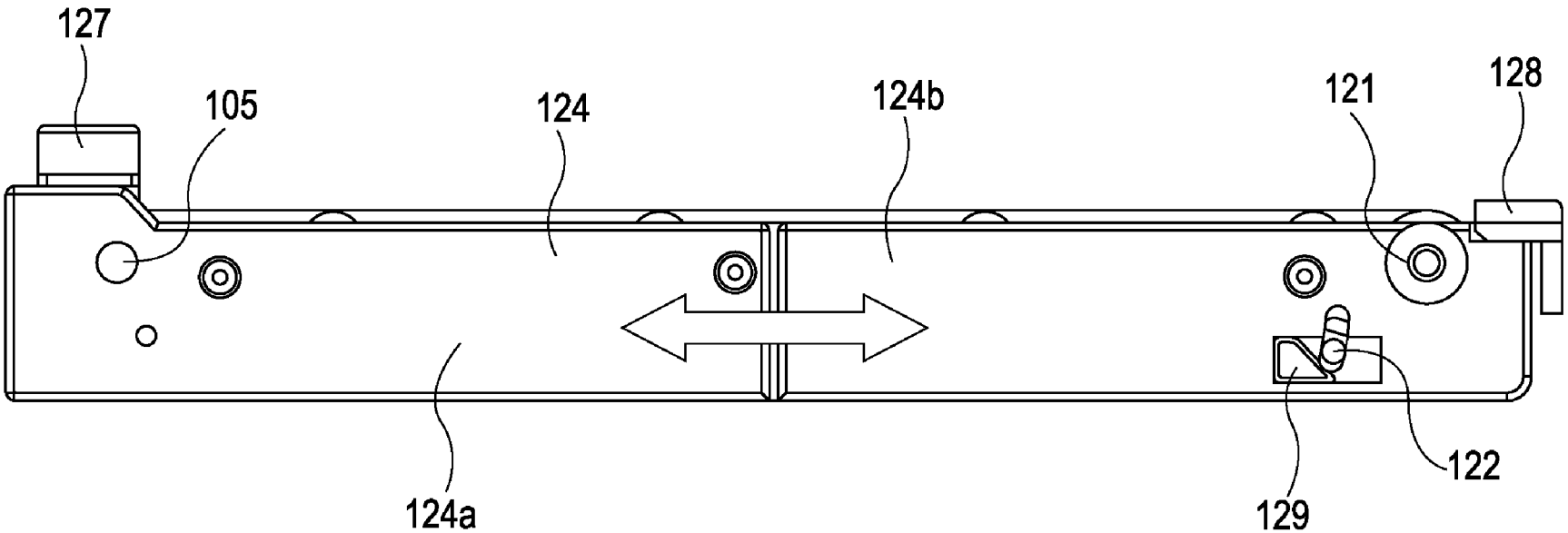
FIG. 7 is a side view of the belt unit in the first embodiment.

A positioning structure for the belt unit 125 will now be described with reference to FIGS. 6 and 7. FIG. 6 is a schematic perspective view illustrating the relationship between the belt unit 125 and the positioning portions 126*a* and 126*b* of the apparatus body frame 126. FIG. 7 is a side view of the belt unit 125.

Referring to FIG. 6, a bearing portion 105*a* is provided in the first belt frame portion 124*a*, and serves as a first holding portion for holing a rotation shaft of the facing roller 105 that is in contact with the inner surface of the intermediate transfer belt 130 so as to stretch the intermediate transfer belt 130. A bearing portion 121*a* is provided in the second belt frame portion 124*b*, and serves as a second holding portion for holding a rotation shaft of the driving roller 121 that is in contact with the inner surface of the intermediate transfer belt 130 so as to stretch the intermediate transfer belt 130. In other words, the facing roller 105 is stretched by the belt frame portion 124*a*, and the driving roller 121 is stretched by the belt frame portion 124*b*. By engaging the bearing portions 105*a* and 121*a* with the positioning portions 126*a* and 126*b* of the apparatus body frame 126, the belt unit 125 is positioned in the apparatus body 101. In this embodiment, the belt frame portions 124*a* and 124*b* that constitute the belt frame 124 are movable in a direction in which the intermediate transfer belt 130 extends (the directions of the arrows in FIG. 7).

With the above-described structure, the facing roller 105 and the driving roller 121 can be aligned by the apparatus body frame 126 by engaging the bearing portion 105*a* of the facing roller 105 with the positioning portion 126*a* of the apparatus body frame 126 and engaging the bearing portion 121*a* of the driving roller 121 with the positioning portion 126*b* of the apparatus body frame 126. For this reason, it is possible to ensure a high positioning accuracy between the facing roller 105 and the driving roller 121 and to achieve stable belt running.

A cleaning portion 127 for removing residual toner remaining on the intermediate transfer belt 130 and a detecting portion 128 for detecting a toner image on the intermediate transfer belt 130 are respectively positioned and fixed to the belt frame portions 124*a* and 124*b*. This ensures a high positioning accuracy between the rollers 105 and 121 while maintaining the positional relationship between the rollers 105 and 121, and the cleaning portion 127 and the detecting portion 128.

A structure for removing pressure from the intermediate transfer belt 130 will now be described with reference to FIGS. 7 to 9.

As shown in FIG. 7, a pressure removing member 129 moves the tension roller 122 serving as the third stretching member from a first position to apply tension to the intermediate transfer belt 130 to a second position to remove the tension. The pressure removing member 129 is provided in the belt frame portion 124*b*. By moving the pressure removing member 129 in the direction of the arrow in FIG. 8, the tension roller 122 serving as the third stretching member is moved from the first position to the second position, and the intermediate transfer belt 130 is freed from tension applied by the tension roller 122.

In order to mount the belt unit 125 in the apparatus body frame 126, the bearing portion 105*a* of the facing roller 105 is engaged with the positioning portion 126*a* of the apparatus body frame 126 and the bearing portion 121*a* of the driving roller 121 is engaged with the positioning portion 126*b* of the apparatus body frame 126 in a state in which the tension roller 122 serving as the third stretching member is at the second position. Through these engagements, the belt unit 125 is positioned by the apparatus body frame 126. Since tension is not applied from the third stretching member to the intermediate transfer belt 130 when the belt unit 125 is mounted in the apparatus body frame 126, the belt unit 125 can be easily positioned and engaged with the positioning portions 126*a* and 126*b* of the apparatus body frame 126. Moreover, the bearing portions are prevented from being worn during mounting.

Figure 8:
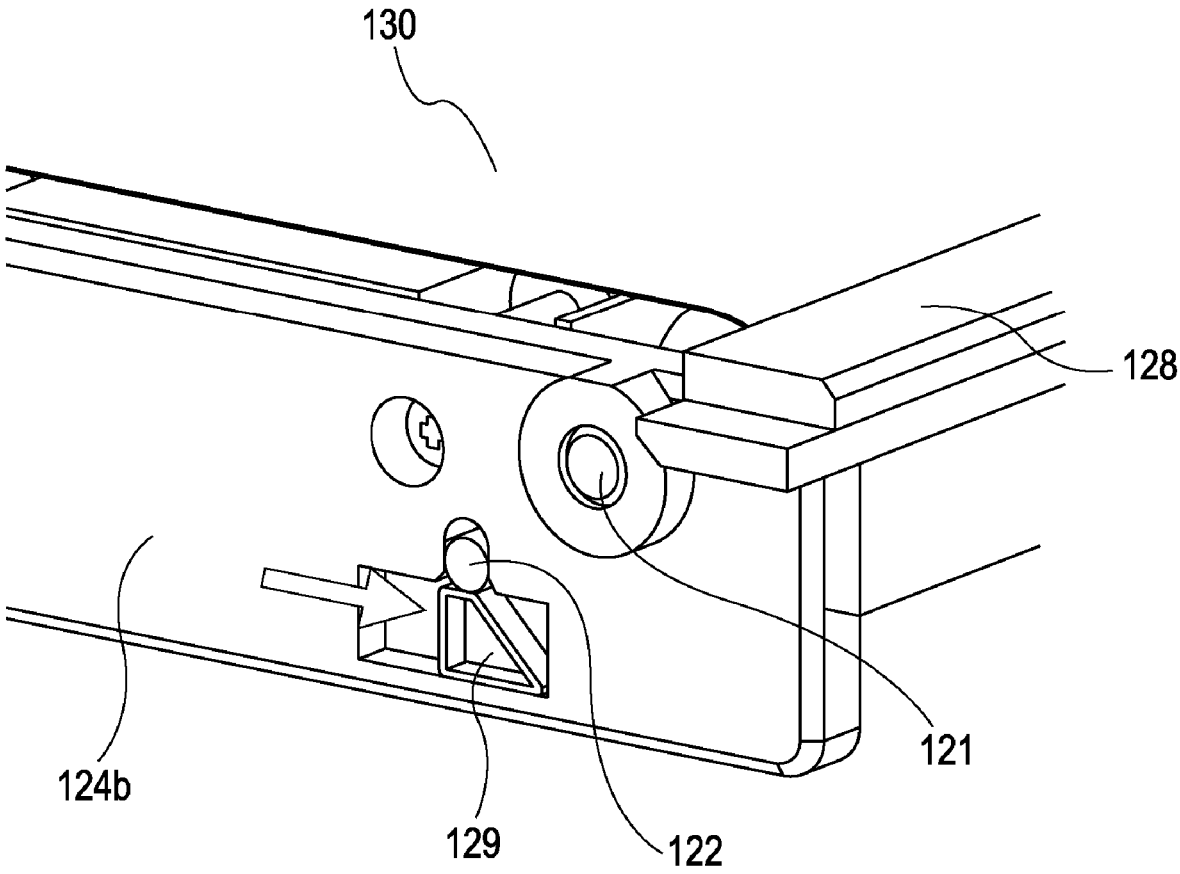
FIG. 8 is an enlarged perspective view showing the principal part of the belt unit in the first embodiment.

By moving the pressure removing member 129 in a direction opposite the direction of the arrow in FIG. 8 after the belt unit 125 is mounted in the apparatus body frame 126, the tension roller 122 is moved from the second position to the first position, and applies tension to the intermediate transfer belt 130.

The pressure removing member 129 can be moved from the first position to the second position or from the second position to the first position manually or automatically. When manual movement is performed, the application of tension from the tension roller 122 to the intermediate transfer belt 130 is canceled by moving the pressure removing member 129 to the position shown in FIG. 8, as described above. By moving the pressure removing member 129 in the direction opposite the direction of arrow in FIG. 8, tension is applied from the tension roller 122 to the intermediate transfer belt 130.

Figure 9:
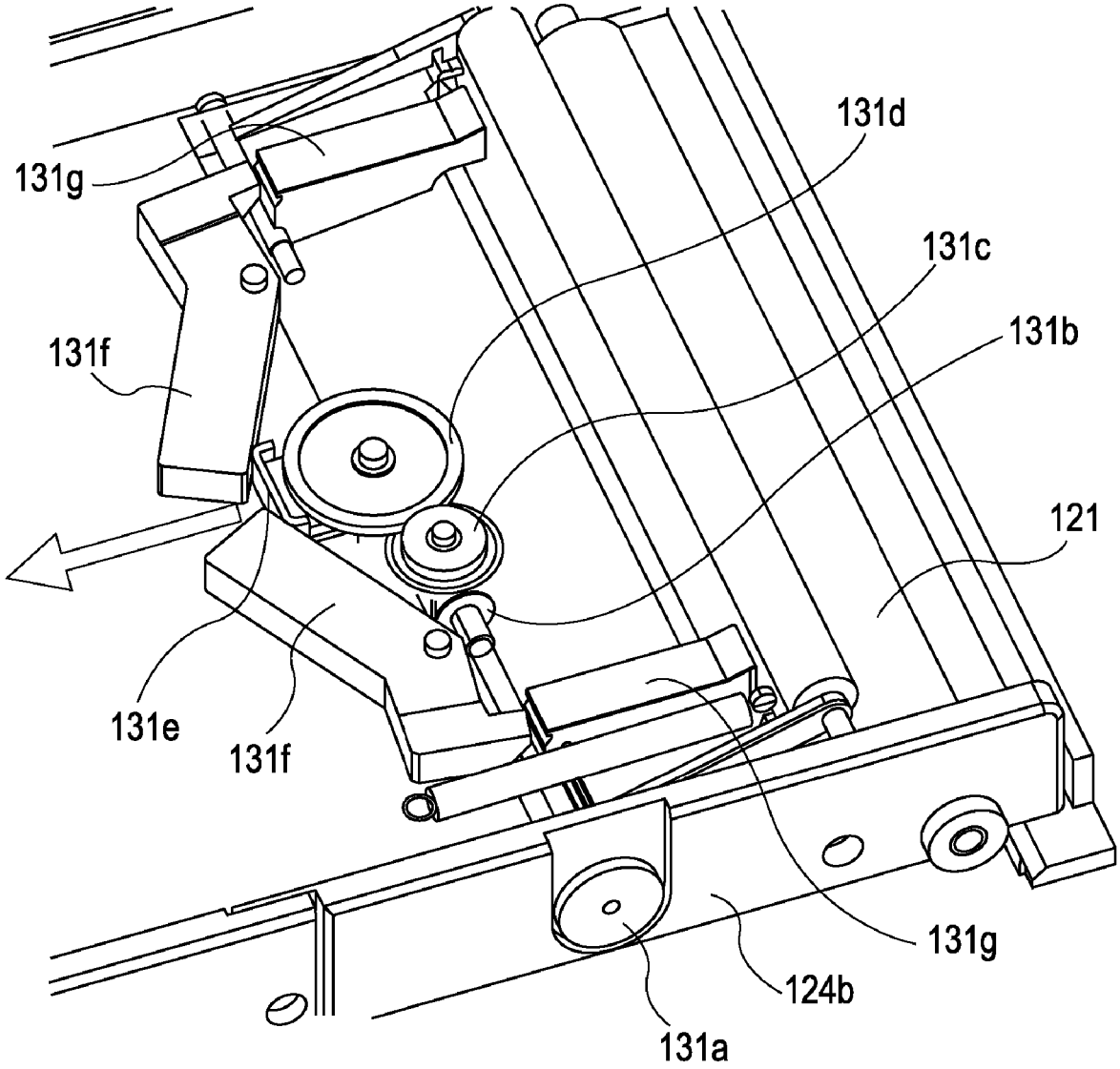
FIG. 9 is a schematic view of a pressure removing mechanism for the belt unit in the first embodiment.

In contrast, automatic movement is performed by a pressure removing mechanism 131 including a pressure removing member shown in FIG. 9. The pressure removing mechanism 131 is automatically driven by the transmission of a driving force from the apparatus body to a pressure removing gear 131*a*. The driving force transmitted to the pressure removing gear 131*a* is further transmitted to pressure removing gears 131*b*, 131*c*, and 131*d*. The pressure removing gear 131*d* has a cam (not shown), and the cam moves a slide member 131*e* in the direction of the arrow in FIG. 9 by the transmission of the driving force. Arm members 131*f* are thereby moved in the direction of the arrow, holding members 131*g* holding the tension roller 122 are turned, and the tension roller 122 moves to the second position to free the intermediate transfer belt 130 from the tension. The holding members 131*g* also serve as pressure removing members. Since the tension can be automatically removed in this way, it is unnecessary to apply tension when the belt unit 125 is mounted, and the pressure can be automatically removed when the belt unit 125 is removed. This makes replacement of the belt unit 125 easier, and enhances usability.

In the above-described structure in which the belt frame portions 124*a* and 124*b* that constitute the belt frame 124 are movable in the direction in which the intermediate transfer belt 130 extends, the two rollers, namely, the facing roller 105 and the driving roller 121 can be aligned by the apparatus body frame 126 by engaging the bearing portion 105*a* of the facing roller 105 with the positioning portion 126*a* of the frame 126 and engaging the bearing portion 121*a* of the driving roller 121 with the positioning portion 126*b* of the frame 126. For this reason, a high positioning accuracy between the facing roller 105 and the driving roller 121 can be ensured, and stable belt running is possible when the belt unit 125 is mounted in the apparatus body. Further, after the belt unit 125 is positioned and mounted in the apparatus body 101 in a state in which the intermediate transfer belt 130 is free from tension, tension is applied to the intermediate transfer belt 130. Therefore, it is unnecessary to engage the bearing portions 105*a* and 121*a* of the facing roller 105 and the driving roller 121 with the positioning portions 126*a* and 126*b* of the apparatus body frame 126 while increasing the center distance between the facing roller 105 and the driving roller 121 against the tension. Since this allows the belt unit 125 to be replaced without changing the center distance between the facing roller 105 and the driving roller 121, operability is enhanced and the bearing portions 105*a* and 121*a* of the rollers 105 and 121 are prevented from being worn by rubbing against the positioning portions 126*a* and 126*b*.

Figure 10:
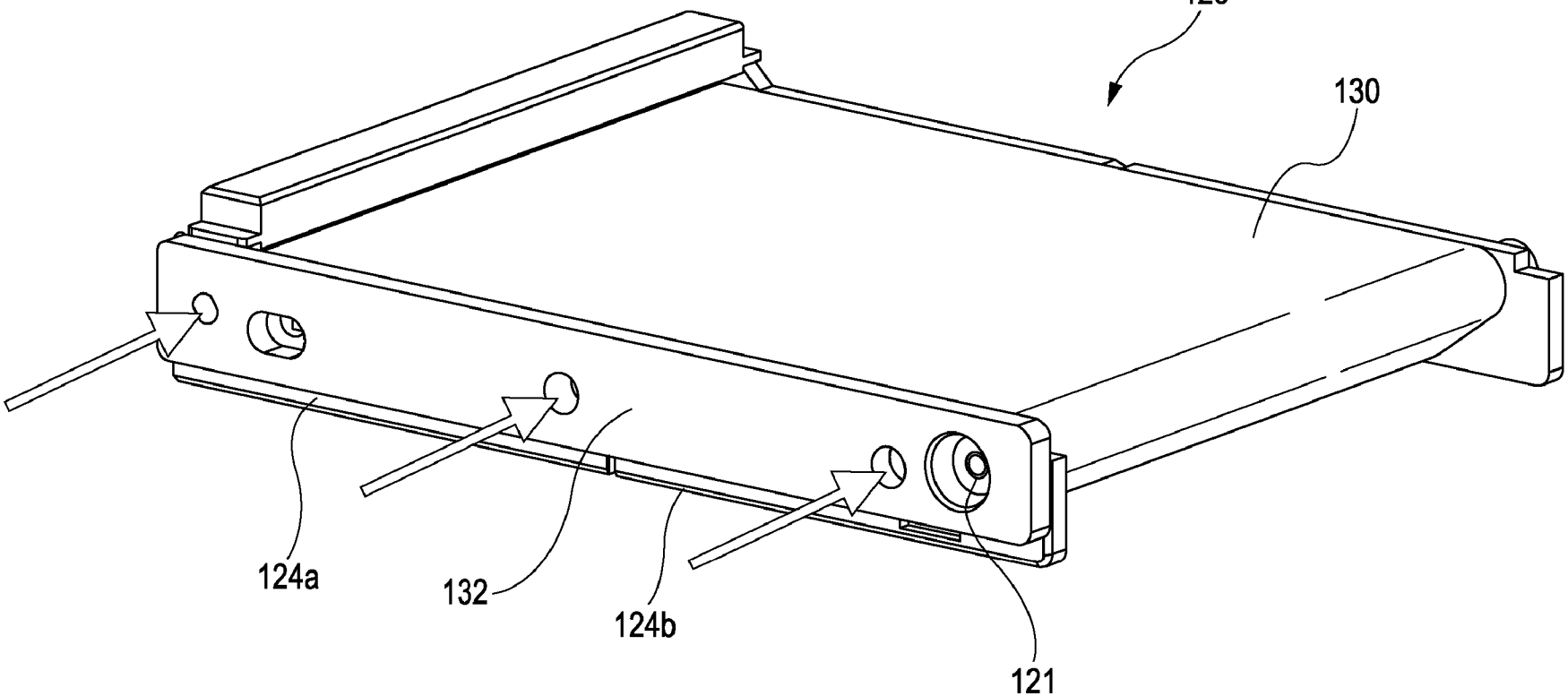
FIG. 10 is a perspective view illustrating the relationship between a belt unit and positioning portions in an apparatus body according to a second embodiment.
Figure 11:
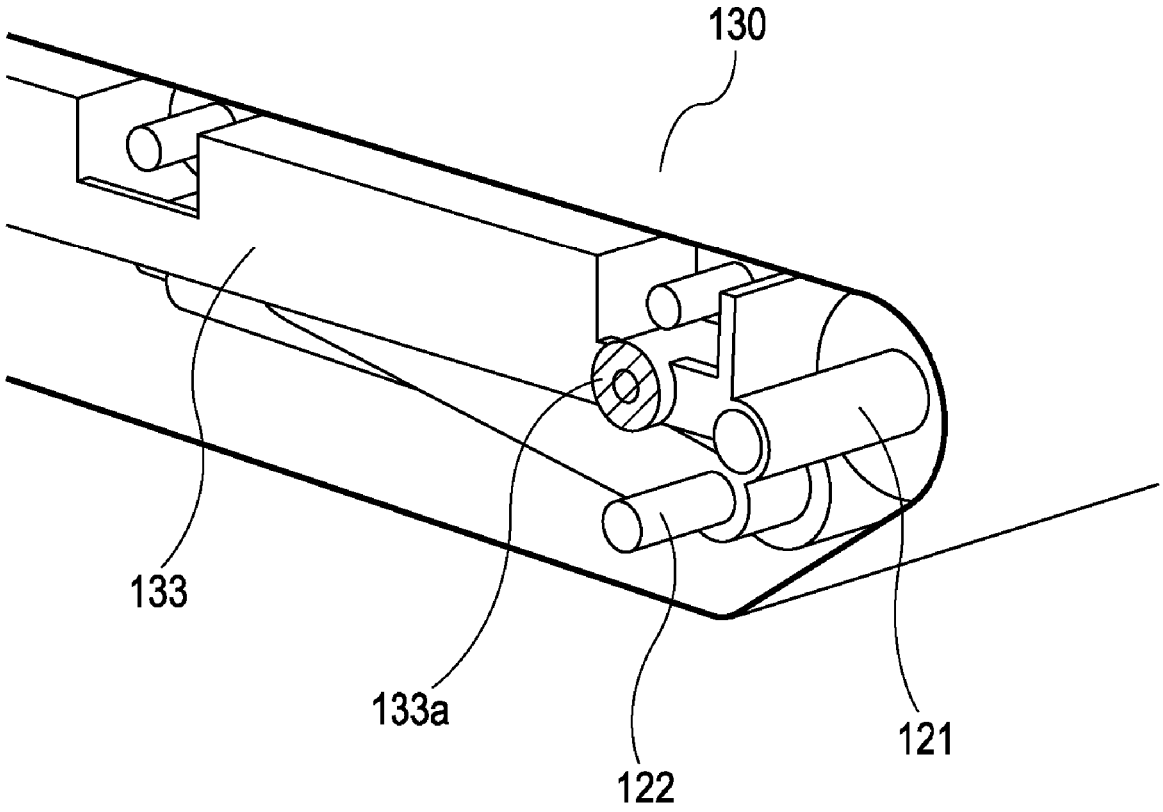
FIG. 11 is an enlarged perspective view showing the principal part of the belt unit in the second embodiment.

A positioning structure for a belt unit according to a second embodiment will now be described with reference to FIGS. 10 and 11. FIG. 10 is a schematic perspective view of the belt unit of the second embodiment. FIG. 11 is a perspective view showing the principal part of the belt unit of the second embodiment.

The second embodiment is substantially identical to the above-described first embodiment except for the structure of the belt unit that will be described below. Therefore, members having equivalent functions are denoted by the same reference numerals, and descriptions thereof are omitted.

A belt unit 125 is fixed by screws to portions shown by the arrows in FIG. 10 in a state in which rollers 105 and 121 stretched by belt frame portions 124*a* and 124*b* are aligned by a positioning tool 132. This can ensure the accuracies of the rollers 105 and 121 that stretch a surface of a belt 130 facing photosensitive drums. In this case, in order to avoid interference between positioning portions of an apparatus body frame and the rollers 105 and 121 that stretch the belt 130 while being in contact with the inner surface of the belt unit 125, it is sufficient to engage only one of the bearings with the corresponding positioning portion.

A belt frame 124 also includes a center frame portion 133 serving as a third frame for fixing the belt frame portions 124*a* and 124*b*. The belt frame portions 124*a* and 124*b* holding the rollers 105 and 121 are fixed to the center frame 133 by screws. In this case, when one of the frame portions 124*a* and 124*b* is movable relative to the center frame portion 133 so that adjustment can be made with the positioning tool 132. In this embodiment, the frame portion 124*b* is movable relative to the center frame portion 133. When the movable frame portion 124*b* is simply screwed to the center frame portion 133, the alignment adjusted and fixed by the tension of the intermediate transfer belt 130 may be disturbed. Accordingly, an adhesive material, such as an adhesive or a double-sided adhesive tape, is provided in a screwing portion 133*a* of the center frame portion 133, and the frame portion 124*b* is screwed in a state in which the adhesive material lies between the frame portion 124*b* and the center frame portion 133. This can prevent displacement due to the tension of the belt.

While the image forming apparatus according to the embodiments uses four image forming sections each including the photosensitive drum and so on, the number of image forming sections is not limited, and can be appropriately determined as needed.

In the above-described embodiments, each process cartridge removably mounted in the image forming apparatus body includes, in combination, a photosensitive drum, and a charging device, a developing device, and a cleaning device serving as processing devices acting on the photosensitive drum. However, the structure of the process cartridge is not limited to the above, and the process cartridge may include, in combination, a photosensitive drum and any one of a charging device, a developing device, and a cleaning device.

While the printer has been given as an example of an image forming apparatus in the above-described embodiments, the present invention is not limited thereto. Other image forming apparatuses can be used as long as they include a detachable belt unit having a belt stretched by a plurality of stretching members. For example, an image forming apparatus, such as a copying machine or a facsimile machine, or an image forming apparatus having functions of these machines in combination, such as a multifunction apparatus, can be used. Alternatively, an image forming apparatus that uses a recording-material bearing member as the belt, that causes a recording material to be electrostatically drawn on the recording-material bearing member, and that sequentially transfers color toner images onto the recording material so that the images are superposed can be used. By applying the present invention to these image forming apparatuses, similar advantages can be obtained.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Patent Application No. 2008-043983 filed Feb. 26, 2008, which is hereby incorporated by reference herein in its entirety.

What is claimed is:

1. An image forming apparatus, comprising:

an image bearing member configured to bear a toner image;

a main body having an apparatus body frame;

a plurality of positioning portions disposed at the apparatus body frame;

a belt unit removable from the main body and configured to be engaged with the plurality of positioning portions so as to be positioned in the main body, the belt unit including an endless belt configured to transfer the toner image from the image bearing member onto a recording material, first and second stretching members configured to stretch an inner face of the belt, a third stretching member configured to stretch the inner surface of the belt so as to apply tension to the belt, and a plurality of belt frames, the plurality of belt frames each including at least a first belt frame configured to hold the first stretching member and a second belt frame configured to hold the second stretching member at least one end of the endless belt in a longitudinal direction; and a pressure removing member configured to move the third stretching member from a first position to apply the tension to the belt to a second position to remove the tension from the belt, wherein, on a same end surface of the endless belt in the longitudinal direction, the first belt frame and the second belt frame are movable independently from each other, the first belt frame includes a first holding portion configured to hold the first stretching member, the second belt frame includes a second holding portion configured to hold the second stretching member, and the first holding portion and the second holding portion are capable of being engaged with the positioning portion independently from each other, and wherein the first holding portion and the second holding portion are engaged with the positioning portion independently from each other in a state in which the pressure removing member restricts the third stretching member to the second position so that the belt unit is positioned in relation to the apparatus body frame, and the pressure removing member moves the third stretching member from the second position to the first position so that the third stretching member applies a tension to the belt.

2. An image forming apparatus according to claim 1, wherein the first stretching member and the second frame portion are positioned and fixed by a positioning tool when the belt unit is assembled.

3. An image forming apparatus according to claim 1, wherein the belt frame includes a third belt frame portion configured to fix the first and second belt frame portions, and wherein the belt unit is positioned in the main body in a state in which an adhesive material is provided between the first belt frame portion and the third belt frame portion or between the second belt frame portion and the third belt frame portion.

4. An image forming apparatus according to claim 1, wherein the toner image on the image bearing member is transferred onto the belt, and the toner image is transferred from the belt onto the recording material.

5. An image forming apparatus according to claim 1, wherein the belt bears the recording material, and the toner image on the image bearing member is transferred onto the recording material born on the belt.

6. An image forming apparatus according to claim 1, wherein the main body transmits a driving force to the pressure removing member after the belt unit is attached to the apparatus body frame so that the pressure removing member moves the third stretching member.

7. A belt unit removable from an image forming apparatus, the belt unit comprising:

an endless belt;

a first stretching member configured to stretch the belt;

a first belt frame having a first holding portion configured to hold the first stretching member;

a second stretching member configured to stretch the belt; and a second belt frame having a second holding portion configured to hold the second stretching member, the second belt frame being movable so that a distance between the first holding portion and the second holding portion is shorter in a state where the belt unit is removed from the image forming apparatus than in a state where the belt unit is attached to the image forming apparatus, and being capable of freeing the belt from urging by the second stretching member in a state where the belt unit is not attached to the image forming apparatus.

8. The belt unit according to claim 7, further comprising a tension member configured to apply tension to the belt.

9. The belt unit according to claim 8, wherein the tension member is movable between a first position where the tension member is in contact with an inner surface of the belt and applies tension to the belt and a second position where the tension member is away from the belt and frees the belt from tension.

10. The belt unit according to claim 9, further comprising a restriction member configured to restrict the tension member to the second position.

11. An image forming apparatus comprising:

an apparatus body frame; and a belt unit removable from the apparatus body frame, the belt unit comprising:

an endless belt;

a first stretching member configured to stretch the belt;

a first belt frame having a first holding portion configured to hold the first stretching member;

a second stretching member configured to stretch the belt; and a second belt frame having a second holding portion configured to hold the second stretching member, the second belt frame being movable so that a distance between the first holding portion and the second holding portion is shorter in a state where the belt unit is removed from the image forming apparatus than in a state where the belt unit is attached to the image forming apparatus, and being capable of freeing the belt from urging by the second stretching member in a state where the belt unit is not attached to the image forming apparatus, wherein the apparatus body frame includes at least one end of the endless belt in a longitudinal direction, a first positioning portion to be engaged with the first holding portion and a second positioning portion to be engaged with the second holding portion.

12. The image forming apparatus according to claim 11, further comprising a tension member configured to apply tension to the belt.

13. The image forming apparatus according to claim 12, wherein the tension member is movable between a first position where the tension member is in contact with an inner surface of the belt and applies tension to the belt and a second position where the tension member is away from the belt and frees the belt from tension.

14. The image forming apparatus according to claim 13, further comprising a restriction member configured to restrict the tension member to the second position.

15. The image forming apparatus according to claim 11, wherein a distance between the first holding portion and the second holding portion of the belt unit in a state where the belt unit is not attached to the apparatus body frame is shorter than a distance between the first positioning portion and the second positioning portion of the apparatus body frame.

* * * * *